US005834384A

United States Patent [19]

Cohen et al.

[11] Patent Number: 5,834,384

[45] Date of Patent: Nov. 10, 1998

[54] NONWOVEN WEBS WITH ONE OR MORE SURFACE TREATMENTS

[75] Inventors: Bernard Cohen, Berkeley Lake; Lamar Heath Gipson, Acworth; Joel Brostin, Alpharetta, all of Ga.

[73] Assignee: Kimberly-Clark Worldwide, Inc., Neenah, Wis.

[21] Appl. No.: 563,811

[22] Filed: Nov. 28, 1995

[51] Int. Cl.[6] ..... B32B 5/06

[52] U.S. Cl. ..... 442/382; 156/272.6; 427/538; 442/381; 442/392; 442/414; 442/415

[58] Field of Search ..... 427/538; 442/381, 442/382, 384, 392, 414, 415; 55/97, 367, 374, 381, 528; 156/272.6

[56] References Cited

U.S. PATENT DOCUMENTS

| | | | |
|---|---|---|---|
| Re. 30,782 | 10/1981 | van Turnhout | 264/22 |
| Re. 31,285 | 6/1983 | van Turnhout et al. | 55/155 |
| Re. 32,171 | 6/1986 | van Turnhout | 55/155 |
| 668,791 | 2/1901 | Blake et al. . | |
| 813,063 | 2/1906 | Sutton et al. . | |
| 859,998 | 7/1907 | Wentworth . | |
| 924,032 | 6/1909 | Blake et al. . | |
| 1,222,305 | 4/1917 | Kraus . | |
| 1,297,159 | 3/1919 | Hedberg . | |
| 1,355,477 | 10/1920 | Howell . | |
| 2,106,865 | 2/1938 | Bantz et al. | 209/127 |
| 2,217,444 | 10/1940 | Hill | 91/18 |
| 2,328,577 | 9/1943 | Oglesby | 117/17 |
| 2,378,067 | 3/1945 | Cook, Jr. | 209/127 |
| 2,398,792 | 4/1946 | Johnson | 209/127 |
| 2,748,018 | 5/1956 | Miller . | |
| 2,998,051 | 8/1961 | Sittel | 154/1.7 |
| 3,012,668 | 12/1961 | Fraas | 209/127 |
| 3,059,772 | 10/1962 | Baron | 209/127 |
| 3,125,547 | 3/1964 | Blatz . | |
| 3,281,347 | 10/1966 | Winder | 204/168 |
| 3,323,933 | 6/1967 | Barford et al. . | |
| 3,338,992 | 8/1967 | Kinney | 264/24 |
| 3,341,007 | 9/1967 | Mayer et al. | 209/2 |
| 3,341,394 | 9/1967 | Kinney | 161/72 |
| 3,380,584 | 4/1968 | Fulwyler | 209/3 |
| 3,402,814 | 9/1968 | Morel et al. | 209/127 |
| 3,436,797 | 4/1969 | Graf et al. | 156/272.6 |
| 3,502,763 | 3/1970 | Hartman | 264/210 |

(List continued on next page.)

FOREIGN PATENT DOCUMENTS

| | | |
|---|---|---|
| 1188452 | 6/1985 | Canada . |
| 0 125 851 | 11/1984 | European Pat. Off. . |
| 0 156 160 | 10/1985 | European Pat. Off. . |
| 0 334 829 | 9/1989 | European Pat. Off. . |
| 0 337 662 | 10/1989 | European Pat. Off. . |
| 0 375 234 | 6/1990 | European Pat. Off. . |
| 0 391 725 | 10/1990 | European Pat. Off. . |
| 0 444 671 | 9/1991 | European Pat. Off. . |
| 0 462 574 | 12/1991 | European Pat. Off. . |
| 0 478 011 | 4/1992 | European Pat. Off. . |
| 0 497 072 | 8/1992 | European Pat. Off. . |
| 0 520 798 | 12/1992 | European Pat. Off. . |
| 0 550 029 | 7/1993 | European Pat. Off. . |
| 0 575 629 | 12/1993 | European Pat. Off. . |
| 0 576 738 | 1/1994 | European Pat. Off. . |
| 0 594 123 | 4/1994 | European Pat. Off. . |
| 0 754 796 | 1/1997 | European Pat. Off. . |
| 1 084 015 | 9/1957 | Germany . |
| 44 47 152 | 7/1995 | Germany . |
| 58-076118 | 7/1958 | Japan . |
| 62-053719 | 8/1987 | Japan . |
| 62-074423 | 9/1987 | Japan . |
| 1-246413 | 10/1989 | Japan . |
| 5-064713 | 3/1993 | Japan . |
| 2 026 379 | 2/1980 | United Kingdom . |
| 2 242 142 | 9/1991 | United Kingdom . |
| 81/03265 | 11/1981 | WIPO . |
| 90/11784 | 10/1990 | WIPO . |
| 91/08254 | 6/1991 | WIPO . |

(List continued on next page.)

OTHER PUBLICATIONS

U.S. application No. 08/198,298, Feb. 22, 1994, Improved Nonwoven Barrier And Method Of Making The Same.

U.S. application No. 08/266,293, Jul. 27, 1994, Improved Nonwoven Barrier And Method Of Making The Same.

U.S. application No. 08/351,966, Dec. 08, 1994, Method Of Forming A Particle Size Gradient In An Absorbent Article.

U.S. application No. 08/366,850, Dec. 30, 1994, Improved Nonwoven Laminate Barrier Material.

U.S. application No. 08/405,485, Mar. 16, 1995, Nonwoven Laminate Barrier Material.

U.S. application No. 08/450,043, May 25, 1995, Filter Matrix.

U.S. application No. 08/504,209, Jul. 19, 1994, Nonwoven Barrier And Method Of Making The Same.

U.S. application No. 08/690,587, Jul. 31, 1996, Improved Nonwoven Barrier.

J. van Turnhout: Topics in Applied Physics, vol. 33, Chapter 3 "Thermally Stimulated Discharge of Electrets", pp. 81–215 (1980).

J. van Turnhout: Thermally Stimulated Discharge of Polymer Electrets, Chapter 1, pp. 1–24 (1975).

G.M. Sessler: Electronic Properties of Polymers, Chapter 3 "Charge Storage", pp. 59–107.

"Bonding Process", IBM Technical Disclosure Bulletin, vol. 14, No. 12, May 1972.

USSN 08/242,948 filed May 16, 1994 entitled "Nonwoven Absorbent Polymeric Fabric Exhibition Improvement Fluid Management And Methods For Making The Same".

(List continued on next page.)

*Primary Examiner*—James J. Bell

*Attorney, Agent, or Firm*—Nancy M. Klembus; David J. Alexander; Jones & Askew

[57] ABSTRACT

A nonwoven web having improved particulate barrier properties is provided. A surface treatment having a breakdown voltage no greater than 13 KV direct current is present on the nonwoven web. The particulate barrier properties are improved by subjecting said surface treatment treated nonwoven web to corona discharge.

28 Claims, No Drawings

U.S. PATENT DOCUMENTS

| | | | |
|---|---|---|---|
| 3,542,615 | 11/1970 | Dobo et al. | 156/181 |
| 3,581,886 | 6/1971 | Singewald et al. | 209/9 |
| 3,692,606 | 9/1972 | Miller et al. | 156/273.1 |
| 3,692,618 | 9/1972 | Dorschner et al. | 161/72 |
| 3,802,817 | 4/1974 | Matsuki et al. | 425/66 |
| 3,821,021 | 6/1974 | McMillan . | |
| 3,849,241 | 11/1974 | Butin et al. | 161/169 |
| 3,855,046 | 12/1974 | Hansen et al. | 161/150 |
| 3,859,330 | 1/1975 | Proskow | 260/47 UA |
| 3,896,802 | 7/1975 | Williams | 128/149 |
| 3,907,604 | 9/1975 | Prentice | 136/146 |
| 3,909,009 | 9/1975 | Cvetko et al. | 274/37 |
| 3,962,386 | 6/1976 | Driscoll | 264/22 |
| 3,979,529 | 9/1976 | Rebentisch et al. | 427/25 |
| 3,998,916 | 12/1976 | van Turnhout | 264/22 |
| 4,011,067 | 3/1977 | Carey, Jr. | 55/354 |
| 4,013,816 | 3/1977 | Sabee et al. . | |
| 4,035,164 | 7/1977 | Taylor . | |
| 4,041,203 | 8/1977 | Brock et al. | 428/157 |
| 4,058,724 | 11/1977 | McKinney et al. . | |
| 4,070,218 | 1/1978 | Weber | 156/167 |
| 4,091,140 | 5/1978 | Harrnon . | |
| 4,096,289 | 6/1978 | Nischwitz et al. | 427/32 |
| 4,103,062 | 7/1978 | Aberson et al. | 428/283 |
| 4,140,607 | 2/1979 | Kreiseimeier et al. | 204/168 |
| 4,170,304 | 10/1979 | Huke . | |
| 4,178,157 | 12/1979 | van Turnhout et al. | 55/155 |
| 4,185,972 | 1/1980 | Nitta et al. . | |
| 4,196,245 | 4/1980 | Kitson et al. | 428/198 |
| 4,208,366 | 6/1980 | Kinney . | |
| 4,209,563 | 6/1980 | Sisson . | |
| 4,215,682 | 8/1980 | Kubik et al. | 128/205.29 |
| 4,223,677 | 9/1980 | Anderson | 128/287 |
| 4,273,635 | 6/1981 | Beraud et al. | 204/165 |
| 4,298,440 | 11/1981 | Hood | 204/165 |
| 4,305,797 | 12/1981 | Knoll et al. | 204/180 R |
| 4,307,143 | 12/1981 | Meitner | 252/91 |
| 4,308,223 | 12/1981 | Stern | 264/22 |
| 4,310,478 | 1/1982 | Balslev et al. . | |
| 4,323,374 | 4/1982 | Shinagawa et al. . | |
| 4,324,198 | 4/1982 | Muz | 118/630 |
| 4,340,563 | 7/1982 | Appel et al. | 264/518 |
| 4,342,812 | 8/1982 | Selwood . | |
| 4,353,799 | 10/1982 | Leonard | 210/321.3 |
| 4,357,234 | 11/1982 | Inculet et al. | 209/127 B |
| 4,363,682 | 12/1982 | Thiebault . | |
| 4,363,723 | 12/1982 | Knoll et al. | 209/128 |
| 4,373,224 | 2/1983 | Bandai et al. . | |
| 4,374,727 | 2/1983 | Takahashi et al. | 209/127 B |
| 4,374,888 | 2/1983 | Bornslaeger | 428/198 |
| 4,375,718 | 3/1983 | Wadsworth et al. | 29/592 |
| 4,392,876 | 7/1983 | Schmidt . | |
| 4,394,235 | 7/1983 | Brandt et al. . | |
| 4,411,795 | 10/1983 | Olson | 210/679 |
| 4,430,277 | 2/1984 | Lin . | |
| 4,443,513 | 4/1984 | Meitner et al. | 422/195 |
| 4,443,515 | 4/1984 | Atlas . | |
| 4,451,589 | 5/1984 | Morman et al. | 523/124 |
| 4,455,195 | 6/1984 | Kinsley | 162/13 |
| 4,455,237 | 6/1984 | Kinsley | 210/767 |
| 4,456,648 | 6/1984 | Adamse et al. . | |
| 4,492,633 | 1/1985 | Sandulyak et al. . | |
| 4,507,539 | 3/1985 | Sando et al. | 219/121 PY |
| 4,513,049 | 4/1985 | Yamasaki et al. . | |
| 4,514,289 | 4/1985 | Inculet | 209/127.3 |
| 4,517,143 | 5/1985 | Kisler . | |
| 4,534,918 | 8/1985 | Forrest, Jr. . | |
| 4,547,420 | 10/1985 | Krueger et al. . | |
| 4,551,378 | 11/1985 | Carey, Jr. | 428/198 |
| 4,554,207 | 11/1985 | Lee | 428/288 |
| 4,555,811 | 12/1985 | Shimalla | 2/51 |
| 4,588,537 | 5/1986 | Klaase et al. | 264/22 |
| 4,592,815 | 6/1986 | Nakao | 204/165 |
| 4,594,626 | 6/1986 | Frangesh . | |
| 4,618,524 | 10/1986 | Groitzsch et al. | 428/198 |
| 4,622,259 | 11/1986 | McAmish et al. | 428/171 |
| 4,623,438 | 11/1986 | Felton et al. | 204/168 |
| 4,626,263 | 12/1986 | Inoue et al. . | |
| 4,652,282 | 3/1987 | Ohmori et al. | 55/155 |
| 4,652,322 | 3/1987 | Lim | 156/181 |
| 4,657,639 | 4/1987 | Mahadevan et al. . | |
| 4,657,804 | 4/1987 | Mays et al. | 428/212 |
| 4,663,220 | 5/1987 | Wisneski | 428/221 |
| 4,670,913 | 6/1987 | Morell et al. | 2/227 |
| 4,671,943 | 6/1987 | Wahlquist . | |
| 4,677,017 | 6/1987 | DeAntonis et al. | 428/214 |
| 4,689,241 | 8/1987 | Richart et al. | 427/28 |
| 4,699,823 | 10/1987 | Kellenberger et al. | 428/219 |
| 4,705,151 | 11/1987 | Eldridge . | |
| 4,707,398 | 11/1987 | Boggs | 428/224 |
| 4,714,647 | 12/1987 | Shipp, Jr. et al. | 428/212 |
| 4,720,415 | 1/1988 | VanderWielen et al. | 428/152 |
| 4,729,371 | 3/1988 | Krueger et al. | 128/206.19 |
| 4,738,772 | 4/1988 | Giesfeldt | 209/2 |
| 4,739,882 | 4/1988 | Parikh et al. . | |
| 4,749,348 | 6/1988 | Klaase et al. | 425/174.8 |
| 4,761,326 | 8/1988 | Barnes et al. | 428/219 |
| 4,789,504 | 12/1988 | Ohmori et al. . | |
| 4,795,668 | 1/1989 | Krueger et al. | 428/174 |
| 4,797,201 | 1/1989 | Kuppers et al. | 209/127.4 |
| 4,797,318 | 1/1989 | Brooker et al. . | |
| 4,818,464 | 4/1989 | Lau | 264/510 |
| 4,826,703 | 5/1989 | Kisler | 427/466 |
| 4,831,664 | 5/1989 | Suda . | |
| 4,847,914 | 7/1989 | Suda . | |
| 4,859,266 | 8/1989 | Akasaki et al. | 156/273.1 |
| 4,863,785 | 9/1989 | Berman et al. | 428/218 |
| 4,863,983 | 9/1989 | Johnson et al. | 524/140 |
| 4,874,399 | 10/1989 | Reed et al. | 55/2 |
| 4,874,659 | 10/1989 | Ando et al. | 428/221 |
| 4,883,052 | 11/1989 | Weiss et al. . | |
| 4,886,527 | 12/1989 | Fottinger et al. | 55/156 |
| 4,894,131 | 1/1990 | Jacobs et al. | 204/165 |
| 4,901,370 | 2/1990 | Suda . | |
| 4,904,174 | 2/1990 | Moosmayer et al. . | |
| 4,920,168 | 4/1990 | Nohr et al. | 524/188 |
| 4,944,854 | 7/1990 | Felton et al. | 204/168 |
| 4,948,515 | 8/1990 | Okumura et al. | 210/748 |
| 4,948,639 | 8/1990 | Brooker et al. | 428/35.2 |
| 4,960,820 | 10/1990 | Hwo | 524/528 |
| 4,965,122 | 10/1990 | Morman | 428/225 |
| 4,983,677 | 1/1991 | Johnson et al. | 525/127 |
| 5,012,094 | 4/1991 | Hamade . | |
| 5,021,501 | 6/1991 | Ohmori et al. | 524/544 |
| 5,032,419 | 7/1991 | Lamirand et al. | 427/470 |
| 5,035,941 | 7/1991 | Blackburn | 428/286 |
| 5,051,159 | 9/1991 | Togashi et al. | 204/165 |
| 5,055,151 | 10/1991 | Duffy . | |
| 5,057,710 | 10/1991 | Nishiura et al. | 307/400 |
| 5,062,158 | 11/1991 | Oka et al. | 2/46 |
| 5,077,468 | 12/1991 | Hamade . | |
| 5,090,975 | 2/1992 | Requejo et al. . | |
| 5,110,620 | 5/1992 | Tani et al. | 427/40 |
| 5,112,048 | 5/1992 | Deeds . | |
| 5,112,677 | 5/1992 | Tani et al. . | |
| 5,118,942 | 6/1992 | Hamade | 250/324 |
| 5,135,724 | 8/1992 | Dinter et al. . | |
| 5,138,971 | 8/1992 | Nakajima et al. . | |
| 5,143,767 | 9/1992 | Matsuura et al. . | |
| 5,149,335 | 9/1992 | Killenberger et al. | 604/372 |
| 5,156,902 | 10/1992 | Pieper et al. | 604/370 |
| 5,165,979 | 11/1992 | Watkins et al. | 428/113 |

| | | | |
|---|---|---|---|
| 5,169,706 | 12/1992 | Collier et al. | 428/152 |
| 5,173,356 | 12/1992 | Eaton et al. | 428/219 |
| 5,178,932 | 1/1993 | Perkins et al. | 428/198 |
| 5,183,701 | 2/1993 | Jacobs et al. | 428/229 |
| 5,188,885 | 2/1993 | Timmons et al. | 428/198 |
| 5,204,174 | 4/1993 | Daponte et al. | 428/286 |
| 5,206,061 | 4/1993 | Ando et al. | 428/37.7 |
| 5,213,881 | 5/1993 | Timmons et al. . | |
| 5,213,882 | 5/1993 | Sassa et al. . | |
| 5,226,992 | 7/1993 | Morman | 156/62.4 |
| 5,230,727 | 7/1993 | Pound et al. | 55/492 |
| 5,232,770 | 8/1993 | Joseph . | |
| 5,238,733 | 8/1993 | Joseph et al. . | |
| 5,244,482 | 9/1993 | Hassenboehler, Jr. | 55/528 |
| 5,246,637 | 9/1993 | Matsuura et al. . | |
| 5,247,072 | 9/1993 | Ning et al. | 536/97 |
| 5,254,297 | 10/1993 | Deeds . | |
| 5,256,176 | 10/1993 | Matsuura et al. | 55/528 |
| 5,257,982 | 11/1993 | Cohen et al. | 604/378 |
| 5,264,276 | 11/1993 | McGregor et al. . | |
| 5,284,703 | 2/1994 | Everhart et al. . | |
| 5,286,326 | 2/1994 | Greve | 156/272.4 |
| 5,294,482 | 3/1994 | Gessner . | |
| 5,306,534 | 4/1994 | Bosses | 428/35.2 |
| 5,308,674 | 5/1994 | Zafiroglu | 428/102 |
| 5,308,691 | 5/1994 | Lim et al. . | |
| 5,336,545 | 8/1994 | Morman | 428/152 |
| 5,350,620 | 9/1994 | Sundet et al. | 428/172 |
| 5,389,202 | 2/1995 | Everhart et al. | 162/103 |
| 5,397,413 | 3/1995 | Trimble et al. | 156/167 |
| 5,401,446 | 3/1995 | Tsai et al. | 264/22 |
| 5,407,581 | 4/1995 | Onodera et al. | 210/654 |
| 5,409,766 | 4/1995 | Yuasa et al. | 428/224 |
| 5,411,576 | 5/1995 | Jones et al. | 95/57 |
| 5,436,033 | 7/1995 | Mino et al. . | |
| 5,436,066 | 7/1995 | Chen | 428/288 |
| 5,441,550 | 8/1995 | Hassenboehler, Jr. | 55/486 |
| 5,443,606 | 8/1995 | Hassenboehler, Jr. | 55/486 |
| 5,455,108 | 10/1995 | Quincy et al. | 428/266 |
| 5,456,972 | 10/1995 | Roth et al. | 428/224 |
| 5,464,688 | 11/1995 | Timmons et al. . | |
| 5,468,428 | 11/1995 | Hanschen et al. . | |
| 5,472,481 | 12/1995 | Jones et al. | 95/15 |
| 5,482,765 | 1/1996 | Bradley et al. . | |
| 5,486,411 | 1/1996 | Hassenboehler, Jr. et al. . | |
| 5,491,022 | 2/1996 | Smith | 428/224 |
| 5,493,117 | 2/1996 | Tamaki et al. | 264/483 |
| 5,496,507 | 3/1996 | Angadjivand et al. | 264/423 |
| 5,503,745 | 4/1996 | Ogata et al. | 210/490 |
| 5,552,012 | 9/1996 | Morris et al. | 156/272.4 |
| 5,620,785 | 4/1997 | Watt et al. | 428/219 |
| 5,637,165 | 6/1997 | Chen | 156/62.2 |

FOREIGN PATENT DOCUMENTS

| | | |
|---|---|---|
| 92/16681 | 10/1992 | WIPO . |
| 93/06168 | 4/1993 | WIPO . |
| 93/09156 | 5/1993 | WIPO . |
| 94/00166 | 1/1994 | WIPO . |
| 94/01068 | 1/1994 | WIPO . |
| WO 94/00166 | 1/1994 | WIPO . |
| 95/05232 | 2/1995 | WIPO . |
| 95/05501 | 2/1995 | WIPO . |
| 95/22646 | 8/1995 | WIPO . |
| 96/00093 | 1/1996 | WIPO . |
| 97/04155 | 2/1997 | WIPO . |

OTHER PUBLICATIONS

An Introduction to Electrostatic Separation, Technical Bulletin, Bulletin 8570, Carpco, Inc.

Electrostatic Separation of Mixed Granular Solids by Oliver C. Ralston, Elsevier Publishing Company, 1961, Chapter IV, "Applications of Electrostatic Separation", pp. 134–234.

Database WPI, Section Ch, Week 8930, Derwent Publications, Ltd., London, GB; Class A94,AN 89–217687 XP002005648 & JP,A,01 156 578 (Showa Denko), 20 Jun. 1989, See Abstract.

Database WPI, Section Ch, Week 8428, Derwent Publications Ltd., London, GB; Class A87, AN 84–173431, XP002008760, & JP,A,59 094 621 (Unitika KK), 31 May 1984, see abstract.

Patent Abstracts of Japan, vol. 10, No. 71 (C–334), 20 Mar. 1986 & JP,A,60 209220 (Kouken K.K.), 21 Oct. 1985, see abstract.

Patent Abstracts of Japan, vol. 6, No 191 (C–127), 30 Sep. 1982 & JP,A,57 105217 (Nitta K.K.), 30 Jun. 1982, see abstract & Chemical Abstracts, vol. 97, No. 26, 27 Dec. 1982, Columbus, Ohio, US; abstract No. 218901, "Fibrous Filtering Material", see abstract.

Patent Abstracts of Japan, vol. 11, No. 315 (C–451), 14 Oct. 1987 & JP,A,62 102809 (Mitsui Petrochem. Ind. Ltd.), 13 May 1987, see abstract & Database WPI, Section CH, Week 8725, Derwent Publications Ltd., London, GB; Class A12, AN 87–172842 & JP,A,62 102 809 (Mitsui Petrochem. Ind. Co. Ltd.), 13 May 1987, see abstract).

Journal of Electrostatics, vol. 21, 1988, Amsterdam NL, pp. 81–98, XP002012022, P. A. Smith & G. C. East: "Generation of Triboelectric Charge in Textile Fibre Mistures, and their use as Air Filters", see document.

NONWOVEN WEBS WITH ONE OR MORE SURFACE TREATMENTS

FIELD OF THE INVENTION

The present invention relates to fabrics useful for forming protective garments. More particularly, the present invention relates to nonwoven webs and surface coatings for such nonwoven webs.

BACKGROUND OF THE INVENTION

There are many types of limited use or disposable protective garments designed to provide barrier properties. Protective garments should be resistant to penetration by both liquids and/or particles. For a variety of reasons, it is undesirable for liquids and pathogens which may be carried by liquids to pass through the garment to contact persons working in an environment where pathogens are present.

Similarly, it is highly desirable to isolate persons from harmful substances which may be present in a work place or accident site. To increase the likelihood that the protective garment is correctly worn thereby reducing the chance of exposure, workers would benefit from wearing a protective garment that is relatively impervious to liquids and/or particles and durable but which is still comfortable so it does not reduce the worker's performance. After use, it is usually quite costly to decontaminate a protective garment that has been exposed to a harmful or hazardous substance. Thus, it is important that a protective garment be cost effective so as to be disposable.

One type of protective garment is disposable protective coveralls. Coveralls can be used to effectively isolate a wearer from a harmful environment in ways that open or cloak style protective garments such as drapes, gowns and the like are unable to do. Accordingly, coveralls have many applications where isolation of a wearer is desirable.

Disposable protective garments also include disposable surgical garments such as disposable surgical gowns and drapes. As is generally known, surgical gowns and drapes are designed to greatly reduce, if not prevent, the transmission through the surgical garment of liquids and biological contaminates which may become entrained therein. In surgical procedure environments, such liquid sources include the gown wearer's perspiration, patient liquids such as blood, saliva, perspiration and life support liquids such as plasma and saline.

Many surgical garments were originally made of cotton or linen and were sterilized prior to their use in the operating room. These surgical garments, however, permitted transmission therethrough or "strike-through" of many of the liquids encountered in surgical procedures. These surgical garments were undesirable, if not unsatisfactory, because such "strike through" established a direct path for transmission of bacteria and other contaminates to and from the wearer of the surgical garment. Furthermore, the garments were costly, and, of course, laundering and sterilization procedures were required before reuse.

Disposable surgical garments have largely replaced linen surgical gowns. Because many surgical procedures require generally a high degree of liquid repellency to prevent strike-through, disposable surgical garments for use under these conditions are, for the most part, made entirely from liquid repellent fabrics.

Therefore, generally speaking, it is desirable that disposable protective garments be made from fabrics that are relatively impervious to liquids and/or particulates. These barrier-type fabrics must also be suited for the manufacture of protective apparel at such low cost that make discarding the garments after only a single use economical.

Examples of disposable protective garments which are generally manufactured from nonwoven web laminates in order to assure that they are cost effectively disposable are coveralls, surgical gowns and surgical drapes sold by the Kimberly-Clark Corporation. Many of the disposable protective garments sold by Kimberly-Clark Corporation are manufactured from a three layer nonwoven web laminate. The two outer layers are formed from spunbonded polypropylene-based fibers and the inner layer is formed from meltblown polypropylene-based fibers. The outer layers of spunbonded fibers provide tough, durable and abrasion resistant surfaces. The inner layer is not only water repellent but acts as a breathable filter barrier allowing air and moisture vapor to pass through the bulk of the fabric while filtering out many harmful particles.

In some instances, the material forming protective garments may include a film layer or a film laminate. While forming protective garments from a film may improve particle barrier properties of the protective garment, such film or film-laminated materials may also inhibit or prevent the passage of air and moisture vapor therethrough. Generally, protective garments formed from materials which do not allow sufficient passage of air and moisture vapor therethrough become uncomfortable to wear correctly for extended periods of time.

Thus, while in some instances, film or film-laminated materials may provide improved particulate barrier properties as compared to nonwoven-laminated fabrics, nonwoven-laminated fabrics generally provide greater wearer comfort. Therefore, a need exists for inexpensive disposable protective garments, and, more particularly, inexpensive disposable protective garments formed from a nonwoven fabric which provide improved particulate barrier properties while also being breathable and thus comfortable to wear correctly for extended periods of time.

SUMMARY OF THE INVENTION

The present invention provides a nonwoven web having improved particulate barrier properties. In one embodiment, the nonwoven web may include at least one layer formed from fibers subjected to corona discharge. The fibers subjected to corona discharge may include a surface treatment having a breakdown voltage no greater than 13 thousand volts (KV) of direct current (DC) and desirably a breakdown voltage no greater than 8 KV DC and more desirably a breakdown voltage no greater than 5 KV DC and most desirably a breakdown voltage of between 1 KV DC and 5 KV DC. The nonwoven web may also include fibers formed from a blend of polypropylene and polybutylene. Desirably, the polybutylene is present in the blend in a range from 0.5 to 20 percent weight of the blend. Another surface treatment having a breakdown voltage greater than 13 KV DC may be present on the fibers subjected to corona discharge or on fibers not subjected to corona discharge or both.

In another embodiment, the nonwoven web may include at least one layer formed from spunbonded fibers and at least one layer formed from meltblown fibers. The fibers of at least one of the layers may be subjected to corona discharge and include a surface treatment having a breakdown voltage no greater than 13 KV DC, and desirably a breakdown voltage no greater than 8 KV DC and more desirably a breakdown voltage no greater than 5 KV DC and most desirably a breakdown voltage of between 1 KV DC and 5

KV DC. The nonwoven web may also include fibers formed from a blend of polypropylene and polybutylene. Desirably, the polybutylene is present in the blend in a range from 0.5 to 20 percent weight of the blend. Another surface treatment having a breakdown voltage greater than 13 KV DC may be present on the fibers subjected to corona discharge or on fibers not subjected to corona discharge or both.

In another embodiment, the nonwoven web may include at least two layers formed from spunbonded fibers and at least one layer formed from meltblown fibers. The layer formed from meltblown fibers is positioned between the two layers formed from spunbonded fibers. The fibers of at least one of the layers may be subjected to corona discharge and include a surface treatment having a breakdown voltage no greater than 13 KV DC, and desirably a breakdown voltage no greater than 8 KV DC and more desirably a breakdown voltage no greater than 5 KV DC and most desirably a breakdown voltage of between 1 KV DC and 5 KV DC. The nonwoven web may also include fibers formed from a blend of polypropylene and polybutylene. Desirably, the polybutylene is present in the blend in a range from 0.5 to 20 percent weight of the blend. Another surface treatment having a breakdown voltage greater than 13 KV DC may be present on the fibers subjected to corona discharge or on fibers not subjected to corona discharge or both.

In another embodiment, the nonwoven web may include at least two layers formed from spunbonded fibers and at least one layer formed from meltblown fibers wherein the layer formed from meltblown fibers is between the two layers formed from spunbonded fibers, and wherein the fibers forming at least one of the layers are subjected to corona discharge. At least one of the layers formed from spunbonded fibers may include a surface treatment having a breakdown voltage no greater than 13 KV DC, and desirably a breakdown voltage no greater than 8 KV DC and more desirably a breakdown voltage no greater than 5 KV DC and most desirably a breakdown voltage of between 1 KV DC and 5 KV DC. The layer formed from meltblown fibers includes a surface treatment having a breakdown voltage no greater than 13 KV DC, and desirably a breakdown voltage no greater than 8 KV DC and more desirably a breakdown voltage no greater than 5 KV DC and most desirably a breakdown voltage of between 1 KV DC and 5 KV DC. The meltblown layer may further be formed from fibers which are formed from a blend of polypropylene and polybutylene, and more particularly, the polybutylene is present in the blend in a range from 0.5 to 20 percent weight of the blend. Another surface treatment having a breakdown voltage greater than 13 KV DC may be present on the fibers subjected to corona discharge or on fibers not subjected to corona discharge or both.

In another embodiment, the nonwoven web includes at least two layers formed from spunbonded fibers and at least one layer formed from meltblown fibers wherein the layer formed from meltblown fibers is between the two layers formed from spunbonded fibers. The fibers forming at least one of the layers includes a surface treatment having a breakdown voltage no greater 13 KV DC, and wherein fibers forming another layer includes another surface treatment having a breakdown voltage greater than 13 KV DC. Each layer formed from fibers which includes a surface treatment is subjected to corona discharge. The spunbonded fibers of one of the layers may include a surface treatment having a breakdown voltage no greater than 13 KV DC, and desirably a breakdown voltage no greater than 8 KV DC and more desirably a breakdown voltage no greater than 5 KV DC and most desirably a breakdown voltage of between 1 KV DC and 5 KV DC. The spunbonded fibers of another layer may also include a surface treatment having a breakdown voltage greater than 13 KV DC. The layer formed from meltblown fibers may include a surface treatment having a breakdown voltage either no greater than 13 KV DC or greater than 13 KV DC or both.

DETAILED DESCRIPTION OF THE INVENTION

As used herein, the term "dielectric" means, according to *McGraw-Hill Encyclopedia of Science & Technology,* 7th Edition, Copyright 1992, a material, such as a polymer, which is an electrical insulator or which an electric field can be sustained with a minimum dissipation of power. A solid material is a dielectric if its valence band is full and is separated from the conduction band by at least 3 eV.

As used herein, the term "breakdown voltage" means that voltage at which electric failure occurs when a potential difference is applied to an electrically insulating material. The breakdown voltage reported for the various materials tested was determined by the ASTM test method for dielectric breakdown voltage (D 877-87).

As used herein, the term "electret" means a dielectric body possessing permanent or semipermanent electric poles of opposite sign.

As used herein, the term "surface treatment" means a material, for example a surfactant, which is present on the surface of another material, for example a shaped polymer such as a nonwoven. The surface treatment may be topically applied to the shaped polymer or may be added to a molten or semi-molten polymer. Methods of topical application include, for example, spraying, dipping or otherwise coating the shaped polymer with the surface treatment. Surface treatments which are added to a molten or semi-molten polymer may be referred to as "internal additives". Internal additives suitable for use in the present invention are generally non-toxic and have a low volatility. Desirably, these internal additives should be thermally stable at temperatures up to 300° C., and sufficiently soluble in the molten or semi-molten polymer and should also sufficiently phase separate such that the additive migrates from the bulk of the shaped polymer towards a surface thereof as the shaped polymer cools.

As used herein, the terms "necking", "neck stretching" or "necked stretched" interchangeably refer to a method of elongating a fabric, generally in the machine direction, to reduce its width in a controlled manner to a desired amount. The controlled stretching may take place under cool, room temperature or greater temperatures and is limited to an increase in overall dimension in the direction being stretched up to the elongation required to break the fabric, which in many cases is about 1.2 to 1.4 times the original unstretched dimension. When relaxed, the web retracts toward its original dimensions. Such a process is disclosed, for example, in U.S. Pat. No. 4,443,513 to Meitner and Notheis and in U.S. Pat. Nos. 4,965,122, 5,226,992 and 5,336,545 to Morman which are all herein incorporated by reference.

As used herein the terms "neck softening" or "necked softened" mean neck stretching carried out without the addition of heat to the material as it is stretched, i.e., at ambient temperature. In neck stretching or softening, a fabric is referred to, for example, as being stretched by 20%.

As used herein, the term "nonwoven web" refers to a web that has a structure of individual fibers or filaments which are interlaid, but not in an identifiable repeating manner.

As used herein the term "spunbonded fibers" refers to fibers which are formed by extruding molten thermoplastic material as filaments from a plurality of fine, usually circular capillaries of a spinnerette with the diameter of the extruded filaments then being rapidly reduced as by, for example, in U.S. Pat. No. 4,340,563 to Appel et al., and U.S. Pat. No. 3,692,618 to Dorschner et al., U.S. Pat. No. 3,802,817 to Matsuki et al., U.S. Pat. Nos. 3,338,992 and 3,341,394 to Kinney, U.S. Pat. Nos. 3,502,763 and 3,909,009 to Levy, and U.S. Pat. No. 3,542,615 to Dobo et al which are all herein incorporated by reference. Spunbonded fibers are generally continuous and in some instances have an average diameter larger than 7 microns.

As used herein the term "meltblown fibers" means fibers formed by extruding a molten thermoplastic material through a plurality of fine, usually circular, die capillaries as molten threads or filaments into a high velocity, usually heated gas (e.g. air) stream which attenuates the filaments of molten thermoplastic material to reduce their diameter. Thereafter, the meltblown fibers are carried by the high velocity gas stream and are deposited on a collecting surface to form a web of randomly disbursed meltblown fibers. Meltblowing is described, for example, in U.S. Pat. No. 3,849,241 to Buntin, U.S. Pat. No. 4,307,143 to Meitner et al., and U.S. Pat. No. 4,707,398 to Wisneski et al which are all herein incorporated by reference. In some instances, meltblown fibers may generally have an average diameter smaller than 10 microns.

Polymers, and particularly polyolefins polymers, are well suited for the formation of fibers or filaments used in forming nonwoven webs which are useful in the practice of the present invention. Nonwoven webs can be made from a variety of processes including, but not limited to, air laying processes, wet laid processes, hydroentangling processes, spunbonding, meltblowing, staple fiber carding and bonding, and solution spinning.

The present invention provides a nonwoven web which may include at least one layer formed from fibers subjected to corona discharge. The nonwoven web may be formed from meltblown fibers or spunbonded fibers or both. The fibers subjected to corona discharge may include a surface treatment having a breakdown voltage no greater than 13 thousand volts or 13 kilovolts (KV) of direct current (DC) and desirably a breakdown voltage no greater than 8 KV DC and more desirably a breakdown voltage no greater than 5 KV DC and most desirably a breakdown voltage of between 1 KV DC and 5 KV DC. The nonwoven web may also include fibers formed from a blend of polypropylene and polybutylene. Desirably, the polybutylene is present in the blend in a range from 0.5 to 20 percent weight of the blend. Another surface treatment having a breakdown voltage greater than 13 KV DC may be present on the fibers subjected to corona discharge or on fibers not subjected to corona discharge or both.

In another embodiment, the nonwoven web may include at least one layer formed from spunbonded fibers and at least one layer formed from meltblown fibers. The fibers of at least one of the layers, and desirably the layer formed from meltblown fibers, may be subjected to corona discharge and include a surface treatment having a breakdown voltage no greater than 13 KV DC, and desirably a breakdown voltage no greater than 8 KV DC and more desirably a breakdown voltage no greater than 5 KV DC and most desirably a breakdown voltage of between 1 KV DC and 5 KV DC. The nonwoven web may also include fibers, and desirably the meltblown fibers, formed from a blend of polypropylene and polybutylene. Desirably, the polybutylene is present in the blend in a range from 0.5 to 20 percent weight of the blend. Another surface treatment having a breakdown voltage greater than 13 KV DC may be present on the fibers subjected to corona discharge or on fibers not subjected to corona discharge or both.

In another embodiment, the nonwoven web may include at least two layers formed from spunbonded fibers and at least one layer formed from meltblown fibers. The layer formed from meltblown fibers may be positioned between the two layers formed from spunbonded fibers. The fibers of at least one of the layers, and desirably the layer formed from meltblown fibers, may be subjected to corona discharge and include a surface treatment having a breakdown voltage no greater than 13 KV DC, and desirably a breakdown voltage no greater than 8 KV DC and more desirably a breakdown voltage no greater than 5 KV DC and most desirably a breakdown voltage of between 1 KV DC and 5 KV DC. The nonwoven web may also include fibers, and desirably meltblown fibers, formed from a blend of polypropylene and polybutylene. Desirably, the polybutylene is present in the blend in a range from 0.5 to 20 percent weight of the blend. Another surface treatment having a breakdown voltage greater than 13 KV DC may be present on the fibers subjected to corona discharge or on fibers not subjected to corona discharge or both.

In another embodiment, the nonwoven web may include at least two layers formed from spunbonded fibers and at least one layer formed from meltblown fibers wherein the layer formed from meltblown fibers may be positioned between the two layers formed from spunbonded fibers, and wherein the fibers forming at least one of the layers are subjected to corona discharge. At least one of the layers formed from spunbonded fibers may include a surface treatment having a breakdown voltage no greater than 13 KV DC, and desirably a breakdown voltage no greater than 8 KV DC and more desirably a breakdown voltage no greater than 5 KV DC and most desirably a breakdown voltage of between 1 KV DC and 5 KV DC. The layer formed from meltblown fibers includes a surface treatment having a breakdown voltage no greater than 13 KV DC, and desirably a breakdown voltage no greater than 8 KV DC and more desirably a breakdown voltage no greater than 5 KV DC and most desirably a breakdown voltage of between 1 KV DC and 5 KV DC. The meltblown layer may further be formed from fibers which are formed from a blend of polypropylene and polybutylene, and more particularly, the polybutylene is present in the blend in a range from 0.5 to 20 percent weight of the blend. Another surface treatment having a breakdown voltage greater than 13 KV DC may be present on the fibers subjected to corona discharge or on fibers not subjected to corona discharge or both.

In another embodiment, the nonwoven web includes at least two layers formed from spunbonded fibers and at least one layer formed from meltblown fibers wherein the layer formed from meltblown fibers may be positioned between the two layers formed from spunbonded fibers. The fibers forming at least one of the layers includes a surface treatment having a breakdown voltage no greater 13 KV DC, and wherein fibers forming another layer includes another surface treatment having a breakdown voltage greater than 13 KV DC. Each layer formed from fibers which includes a surface treatment is subjected to corona discharge. The spunbonded fibers of one of the layers may include a surface treatment having a breakdown voltage no greater than 13 KV DC, and desirably a breakdown voltage no greater than 8 KV DC and more desirably a breakdown voltage no greater than 5 KV DC and most desirably a breakdown voltage of between 1 KV DC and 5 KV DC. The spunbonded fibers of the other layer may include a surface treatment having a breakdown voltage greater than 13 KV DC. The layer formed from meltblown fibers may include a surface treatment having a breakdown voltage either no greater than 13 KV DC or greater than 13 KV DC or both.

As described in greater detail below, the entire thickness of the nonwoven web laminate may be subjected to corona discharge. Alternatively, individual nonwoven layers which, when combined, form the nonwoven web laminate may be separately subjected to corona discharge. When the entire thickness of the nonwoven web laminate is subjected to corona discharge, the fibers forming at least one of the nonwoven layers are desirably formed from a variety of dielectric polymers including, but not limited to, polyesters, polyolefins, nylon and copolymer of these materials. The fibers forming the other nonwoven layers may be formed from a variety of non-dielectric polymers, including, but not limited to, cellulose, glass, wool and protein polymers.

When one or more individual nonwoven layers are separately subjected to corona discharge, the fibers forming these nonwoven layers are desirably formed from the above described dielectric polymers. Those individual nonwoven layers which are not subjected to corona discharge may be formed from the above described non-dielectric polymers.

It has been found that nonwoven webs formed from thermoplastic based fibers and particularly polyolefin-based fibers are particularly well-suited for the above applications. Examples of such fibers include spunbonded fibers and meltblown fibers. Examples of such nonwoven webs formed from such fibers are the polypropylene nonwoven webs produced by the Assignee of record, Kimberly-Clark Corporation.

As previously described above, one embodiment of the present invention may include a nonwoven web laminate. For example, the nonwoven web laminate may include at least one layer formed from spunbonded fibers and another layer formed from meltblown fibers, such as a spunbonded/meltblown (S/M) nonwoven web laminate. In another embodiment, the nonwoven web laminate may include at least one layer formed from meltblown fibers which is positioned between two layers formed from spunbonded fibers, such as a spunbonded/meltblown/spunbonded (S/M/S) nonwoven web laminate. Examples of these nonwoven web laminates are disclosed in U.S. Pat. No. 4,041,203 to Brock et al., U.S. Pat. No. 5,169,706 to Collier, et al, and U.S. Pat. No. 4,374,888 to Bornslaeger which are all herein incorporated by reference. More particularly, the spunbonded fibers may be formed from polypropylene. Suitable polypropylenes for the spunbonded layers are commercially available as PD-9355 from the Exxon Chemical Company of Baytown, Tex.

More particularly, the meltblown fibers may be formed from polyolefin polymers, and more particularly a blend of polypropylene and polybutylene. Examples of such meltblown fibers are contained in U.S. Pat. Nos. 5,165,979 and 5,204,174 which are incorporated herein by reference. Still more particularly, the meltblown fibers may be formed from a blend of polypropylene and polybutylene wherein the polybutylene is present in the blend in a range from 0.5 to 20 weight percent of the blend. One such suitable polypropylene is designated 3746-G from the Exxon Chemical Co., Baytown, Tex. One such suitable polybutylene is available as DP-8911 from the Shell Chemical Company of Houston, Tex. The meltblown fibers may also contain a polypropylene modified according to U.S. Pat. No. 5,213,881 which is incorporated herein by reference.

The S/M/S nonwoven web laminate may be made by sequentially depositing onto a moving forming belt first a spunbonded fabric layer, then a meltblown fabric layer on top to the first spunbonded fabric and last another spunbonded fabric layer on top of the meltblown fabric layer and then bonding the laminate in a manner described below. Alternatively, the layers may be made individually, collected in rolls, and combined in a separate bonding step. Such S/M/S nonwoven web laminates usually have an average basis weight of from about 0.1 to 12 ounces per square yard (osy) (3 to 400 grams per square meter (gsm)), or more particularly from about 0.75 to about 5 osy (25 to 170 gsm) and still more particularly from about 0.75 to about 3 osy (25 to 100 gsm).

Methods of subjecting nonwoven webs to corona discharge, are well known by those skilled in the art. Briefly, corona discharge is achieved by the application of sufficient direct current (DC) voltage to an electric field initiating structure (EFIS) in the proximity of an electric field receiving structure (EFRS). The voltage should be sufficiently high such that ions are generated at the EFIS and flow from the EFIS to the EFRS. Both the EFIS and the EFRS are desirably formed from conductive materials. Suitable conductive materials include copper, tungsten, stainless steel and aluminum.

One particular technique of subjecting nonwoven webs to corona discharge is the technique disclosed in U.S. Pat. No. 5,401,446 which is assigned to the University of Tennessee, and is herein incorporated by reference. This technique involves subjecting the nonwoven web to a pair of electrical fields wherein the electrical fields have opposite polarities. Each electrical field forms a corona discharge.

In those instances where the nonwoven web is a nonwoven web laminate, the entire thickness of the nonwoven web laminate may be subjected to corona discharge. In other instances, one or more of the individual layers which form the nonwoven web laminate or the fibers forming such individual layers may be separately subjected to corona discharge and then combined with other layers in a juxtaposed relationship to form the nonwoven web laminate. In some instances, the electric charge on the surface of the nonwoven web laminate prior to corona discharge may be substantially the same as the electric charge on the surface of the corona discharge treated web. In other words, the surface of the nonwoven web laminate may not generally exhibit a higher electric charge after subjecting the web to corona discharge than the electric charge present on the surface of the web before subjecting it to corona discharge.

Nonwoven web laminates may be generally bonded in some manner as they are produced in order to give them sufficient structural integrity to withstand the rigors of further processing into a finished product. Bonding can be accomplished in a number of ways such as hydroentanglement, needling, ultrasonic bonding, adhesive bonding and thermal bonding.

Ultrasonic bonding is performed, for example, by passing the nonwoven web laminate between a sonic horn and anvil roll as illustrated in U.S. Pat. No. 4,374,888 to Bornslaeger.

Thermal bonding of a nonwoven web laminate may be accomplished by passing the same between the rolls of a calendering machine. At least one of the rollers of the calender is heated and at least one of the rollers, not necessarily the same one as the heated one, has a pattern which is imprinted upon the laminate as it passes between the rollers. As the fabric passes between the rollers it is subjected to pressure as well as heat. The combination of heat and pressure applied in a particular pattern results in the creation of fused bond areas in the nonwoven web laminate where the bonds thereon correspond to the pattern of bond points on the calender roll.

Various patterns for calender rolls have been developed. One example is the Hansen-Pennings pattern with between about 10 to 25% bond area with about 100 to 500 bonds/square inch as taught in U.S. Pat. No. 3,855,046 to Hansen and Pennings. Another common pattern is a diamond pattern with repeating and slightly offset diamonds.

The exact calender temperature and pressure for bonding the nonwoven web laminate depend on the thermoplastic(s) from which the nonwoven web is made. Generally for nonwoven web laminates formed from polyolefins, desirable temperatures are between 150° and 350° F. (66° and 177° C.) and the pressure is between 300 and 1000 pounds per linear inch. More particularly, for polypropylene, the desirable temperatures are between 270° and 320° F. (132° and 160° C.) and the pressure is between 400 and 800 pounds per linear inch.

In those instances where the nonwoven web is used in or around flammable materials and static discharge is a concern, the nonwoven web may be treated with any number of antistatic materials. In these instances, the antistatic material may be applied to the nonwoven by any number of techniques including, but not limited, to dipping the nonwoven into a solution containing the antistatic material or by spraying the nonwoven with a solution containing the antistatic material. In some instances the antistatic material may be applied to both the external surfaces of the nonwoven and/or the bulk of the nonwoven. In other instances, the antistatic material may be applied to portions of the nonwoven, such as a selected surface or surfaces thereof.

Of particular usefulness is the antistat or antistatic material known as ZELEC®, an alcohol phosphate salt product of the Du Pont Corporation. The nonwoven web may be treated with the antistatic material either before or after subjecting the web to charging. Furthermore, some or all of the material layers may be treated with the antistatic material. In those instances where only some of the material layers are treated with antistatic material, the non-treated layer or layers may be subjected to charging prior to or after combining with the antistatic treated layer or layers.

Additionally, in those instances where the nonwoven web is used around alcohol, the nonwoven web may be treated with an alcohol repellent material. In these instances, the alcohol repellent material may be applied to the nonwoven by any number of techniques including, but not limited to, dipping or by spraying the nonwoven web with a solution containing the alcohol repellent material. In some instances the alcohol repellent material may be applied to both the external surfaces of the nonwoven and the bulk of the nonwoven. In other instances, the alcohol repellent material may be applied to portions of the nonwoven, such as a selected surface or surfaces thereof.

Of particular usefulness are the alcohol repellent materials formed from fluorinated urethane derivatives, an example of which includes FX-1801. FX-1801, formerly called L-10307, is available from the 3M Company of St. Paul, Minn. FX-1801 has a melting point of about 130° to 138° C. FX-1801 may be added to either the spunbonded and/or meltblown layer at an amount of about 0.1 to about 2.0 weight percent or more particularly between about 0.25 and 1.0 weight percent. FX-1801 may be topically applied or may be internally applied by adding the FX-1801 to the fiber forming polymer prior to fiber formation.

Generally, internal additives, such as the alcohol repellent additive FX-1801, suitable for use in the present invention should be non-toxic and have a low volatility. Additionally, the internal additive should be thermally stable at temperatures up to 300° C., and sufficiently soluble in the molten or semi-molten fiber forming polymer. The internal additive should also sufficiently phase separate such that the additive migrates from the bulk of the polymer fiber towards the surface of the polymer fiber as the fiber cools without requiring the addition of heat. The layers of the fabric of the present invention may also contain fire retardants for increased resistance to fire, pigments to give each layer the same or distinct colors, and/or chemicals such as hindered amines to provide enhanced ultraviolet light resistance. Fire retardants and pigments for spunbonded and meltblown thermoplastic polymers are known in the art and may be internal additives. A pigment, if used, is generally present in an amount less than 5 weight percent of the layer.

EXAMPLES

To demonstrate the attributes of the present invention, several surface treatments were combined with nonwoven webs of various average basis weights and polymer blends as listed in TABLE I.

TABLE 1*

| SURFACE TREATMENT INDUSTRIAL DESIGNATION | CHEMICAL DESCRIPTION | AMOUNT APPLIED TO SURFACE | TYPE OF NONWOVEN WEB |
|---|---|---|---|
| 1. Y-12488 | Polyalkyleneoxide Modified Polydimethysiloxane Union Carbide Corporation | 4% and 1% | 1.5 osy M |
| 2. HYPERMER A409 | Modified Polyester Surfactant 98%; Xylene 2%; ICI America Inc. | 4% | 1.5 osy M |
| 3. FC1802 | C8 Fluorinated Alkyl Alkoxylate 86–89%; C8 Fluorinated Alkyl Sulfonamide 9–10%; C7 Fluorinated Alkyl Alkocylate 2–4%; C7 Fluorinated Alkyl Sulfonamide 0.2–1%; 3M Corp. | 2.4% | 1.5 osy M |

TABLE 1*-continued

| SURFACE TREATMENT INDUSTRIAL DESIGNATION | CHEMICAL DESCRIPTION | AMOUNT APPLIED TO SURFACE | TYPE OF NONWOVEN WEB |
|---|---|---|---|
| 4. FX 1801 | Fluorochemical Urethane Derivative - 100% - 3M Corp. | 1%** (contained 0.03% ZELEC) | 1.6 osy S/M/S |
| 5. TEGOPREN 5830 | Polysiloxane Polyether Copolymer - Goldschmidt Corp. | 4% | 1.5 osy M |
| 6. TRITON X102 | Octlyphenoxypoylethoxy Ethanol having 12–13 Ethylene Oxide Groups - Rohm & Haas Co. | 2% | 1.5 osy M |
| 7. ZELEC | Alcohol Phosphate Salt; Neutralized Mixed Alkyl Phosphates - Du Pont | .03%*** | 2.2 osy S/M/S KIMGUARD ®, & 1.6 osy S/M/S |
| 8. FC808 | Polymeric Fluoroalphatic Ester 3M Corp. | 2.95% | 1.8 osy S/M/S KLEENGUARD ® |
| 9. MASIL SF19 | Silicon Surfactant PPG | 2% | 1.5 osy M |
| 10. GEMTEX SM33 | Dioctyl Sodium Sulfosuccinate Based Anionic Finetex Corp. | .3% | 1.5 osy M |

S/M/S Spunbonded/Meltblown/Spunbonded Nonwoven Web Laminate
S Spunbonded Nonwoven Web
M Meltblown Nonwoven Web
*All surface treatments applied topically except as noted.
**Applied to molten polymer. Bloomed to surface of M.
***Applied topically to one S layer.

For samples 1–3, 5, 6, 9 and 10, the respective surface treatments were applied to a meltblown nonwoven web having an average basis weight of about 1.5 ounce per square yard (osy). These webs were made from Himont PF105 polypropylene.

For sample 4 and a portion of the nonwoven webs utilized in sample 7, the respective surface treatments were applied to a S/M/S laminate having an average basis weight of about 1.6 osy. These samples included a meltblown layer having an average basis weight of about 0.5 osy between two layers of spunbonded material, each spunbonded layer having an average basis weight of about 0.55 osy. The spunbonded layers were made from polypropylene copolymer designated PD-9355 by Exxon chemical Co. The meltblown layer was made from polypropylene designated 3746G from Exxon Chemical and polybutylene (10 weight percent) designated DP-8911 from Shell. The samples were necked softened by 8 percent at ambient temperature. The ZELEC surface treatment was present on one of the spunbonded surfaces in an amount of around 0.03% by weight of the spunbonded layer. Present in the meltblown layer of each of the above samples was FX 1801.

For the remaining portion of the nonwoven webs utilized in sample 7, the ZELEC surface treatment was applied to a S/M/S laminate having an average basis weight of about 2.2 osy. Both spunbonded layers had an average basis weight of around 0.85 osy and the meltblown layer had an average basis weight of around 0.5 osy. One of the spunbonded layers of this sample contained about 0.03% by weight of the spunbonded layer of ZELEC surface treatment.

For sample 8, the respective surface treatment was applied to a 1.8 osy S/M/S laminate. The spunbonded layers were formed from polypropylene resins—Exxon PD-3445 and Himont PF-301. White and dark blue pigments, Ampacet 41438 (Ampacet Inc., N.Y.) and SCC 4402 (Standrige Color Inc., GA.), respectively, were added to the polypropylene resins forming one of the spunbonded layers. The other spunbonded layer was formed from these polypropylene resins without pigments. The meltblown layer was formed from the polypropylene resin Himont PF-015 without pigments.

The meltblown layer had an average basis weight of about 0.45 osy and each spunbonded layer had an average basis weight of about 0.675 osy. The 2.95% FC808 solution was prepared by adding 0.5% hexanol, 2.95% FC808 and about 96.5% water. The FC808 solution was applied to one of the spunbonded layers. FC808 is an alcohol repellent surface treatment formed from a polymeric fluoroaliphatic ester (20%), water (80%) and traces of ethyl acetate (400 parts/million).

A portion of each of the surface treatment treated nonwoven webs described in TABLE 1, (samples 1–10) was removed and not subjected to corona discharge. The remainder of each of the surface treatment treated nonwoven web samples (1–10) was subjected to corona discharge. The corona discharge was produced by using a Model No. P/N 25A—120volt, 50/60 Hz reversible polarity power unit (Simco Corp., Hatfield, Pa.), which was connected to the EFIS, and a Model No. P16V 120V,.25A 50/60 Hz power unit (Simco Corp., Hatfield, Pa.) which was connected to the EFRS. The EFIS was a RC-3 Charge Master charge bar (Simco. Corp.) and the EFRS was a solid, three inch diameter, aluminum roller. The corona discharge environment was generally about 71° F. and 53% relative humidity. As described in the above U.S. Pat. No. 5,401,446, two sets of EFIS/EFRS are used. The voltage applied to the first set of EFIS/EFRS was 15 KV DC/0.0 KV DC, respectively. The voltage applied to the second set of EFIS/EFRS was 25 KV DC/7.5 KV DC, respectively. The gap between the EFIS and the EFRS for each set was one inch.

The filtration efficiency for both corona treated and non-corona treated nonwoven web samples was analyzed. The particulate filtration test used to evaluate the particulate filtration properties of these nonwovens is generally known as the NaCl Filter Efficiency Test (hereinafter the "NaCl Test"). The NaCl Test was conducted on an automated filter tester, Certitest™ Model #8110, which is available from TSI Inc., St. Paul, Minn. The particulate filtration efficiency of the test fabric is reported as "% penetration". "% penetration" is calculated by the following formula—100× (downstream particles/upstream particles). The upstream particles represent the total quantity of approximately 0.1 μm NaCl aerosol particles which are introduced into the tester. The downstream particles are those particles which have been introduced into the tester and which have passed through the bulk of the test fabric. Therefore, the "% penetration" value reported in TABLES I–V is a percentage of the total quantity of particles introduced into a controlled air flow within the tester which pass through the bulk of the test fabric. The size of the test fabric was 4.5" in diameter. The air flow may be constant or varied. At about 32 liters per minute of air flow, a pressure differential of between 4 and 5 mm Water Gage develops between the atmosphere on the upstream side of the test fabric as compared to the atmosphere on the down stream side of the test fabric. The filtration efficiency results for samples 1–6 and 8–10 are reported in TABLE 2. The filtration efficiency results for sample 7, the ZELEC surface treatment treated nonwovens webs, are not reported in TABLE 2.

TABLE 2

| SURFACE TREATMENT | FILTRATION EFFICIENCY % PENETRATION 0.1 μ NaCl CORONA TREATED | NON-CORONA TREATED |
|---|---|---|
| 1. Y 12488 (1%) | 66.3 | 70.6 |
| 1. Y 12488 (4%) | 54.3 | 55.2 |
| 2. A409 | 10.0 | 46.0 |
| 3. FC 1802 | 51.0 | 53.7 |
| 4. ZELEC + 1801 | 2.57 | 33.2 |
| 5. 5830 | 57.5 | 57.7 |
| 6. TRITON 102 | 1.30 | 51.3 |
| 8. FC808 | 62.4 | 63.0 |
| 9. SF19 | 45.5 | 80.9 |
| 10. GEMTEX SM33 | 6.30 | 71.2 |

In view of TABLE 2, it was concluded that in those instances where there existed a substantial increase in filtration efficiency of the surface treatment treated nonwoven web between the non-corona treated and the corona treated, the corona treated nonwoven web had formed an electret.

Based upon the filtration efficiency results reported in TABLE 2, four liquid surface treatments were selected for breakdown voltage analysis. The filtration efficiency data for two of the liquid surface treatments, Y 12488 and TEGOPREN 5830, indicated generally an insubstantial difference in filtration efficiency between corona and non-corona treatment. The filtration efficiency data for the other two liquid surface treatments, TRITON 102 and SF19, indicated generally a substantial improvement in the filtration efficiency between corona and non-corona treatment.

The breakdown voltages for these liquid surface treatments are reported in TABLE 3. The breakdown voltage for each liquid surface treatment was determined by using a Hipot Tester, model no. Hipotronics 100, having a range of 0–25 KV DC and an accuracy of +/−2%. The electrodes were one inch diameter brass electrodes spaced 0.100 inches apart. The electrodes were submersed in a neat quantity of the respective liquid surface treatments. The voltage to the electrodes was increased from 0 KV DC at an approximate rate of 3 KV DC/second until breakdown occurred. The electrodes and the test vessel were thoroughly washed, rinsed with distilled water, and air dried before testing the next surface treatment.

TABLE 3

BREAKDOWN VOLTAGES*

| MATERIAL | BREAKDOWN VOLTAGE (DC) |
|---|---|
| Y 12488 | 24 KV |
| MASIL SF19 | 4.8 KV |
| TEGOPREN 5830 | 15 KV |
| TRITON X-102 | 1.8 KV |

*CURRENT AT BREAKDOWN VOLTAGE VARIED FROM 3.5 milliamps (MA) TO 4.9 MA.

For two of the liquid surface treatments, Y 12488 and TEGOPREN 5830, which indicated generally an insubstantial difference in filtration efficiency between corona and non-corona treatment, the breakdown voltages were 24 KV DC and 15 KV DC, respectively. For the two liquid surface treatments, TRITON 102 and SF19, which indicated generally a substantial improvement in the filtration efficiency between corona and non-corona treatment, the breakdown voltages were 1.8 KV DC and 4.8 KV DC, respectively.

While the invention has been described in detail with respect to specific embodiments thereof, it will be appreciated that those skilled in the art, upon attaining an understanding of the foregoing, may readily conceive of alterations to, variations of and equivalents to these embodiments. Accordingly, the scope of the present invention should be assessed as that of the appended claims and any equivalents thereto.

What is claimed is:

1. A nonwoven electret comprising:

at least one layer of fibers, wherein the fibers have been subjected to corona discharge and include a surface treatment having a breakdown voltage no greater than 13 KV of direct current.

2. The nonwoven electret of claim 1, wherein the fibers comprise a blend of polypropylene and polybutylene.

3. The nonwoven electret of claim 1, wherein the breakdown voltage of the surface treatment is less than 8 KV of direct current.

4. The nonwoven electret of claim 2, wherein the polybutylene is present in the blend in a range from 0.5 to 20 percent weight of the blend.

5. A nonwoven electret comprising:

at least two layers of spunbonded fibers and at least one layer of meltblown fibers, wherein the layer of meltblown fibers is between the two layers of spunbonded fibers, wherein fibers of at least one layer have been subjected to corona discharge; and wherein the fibers which have been subjected to corona discharge include a surface treatment having a breakdown voltage no greater than 13 KV of direct current.

6. The nonwoven electret of claim 5, wherein the meltblown fibers comprise a blend of polypropylene and polybutylene.

7. The nonwoven electret of claim 6 wherein the polybutylene is present in the blend in a range from 0.5 to 20 percent weight of the blend.

8. The nonwoven electret of claim 5 wherein the average basis weight of the nonwoven web is about 1.8 ounces per square yard.

9. The nonwoven electret of claim 5, wherein the meltblown fibers have been subjected to corona discharge.

10. A nonwoven electret comprising:

at least two layers of spunbonded fibers and at least one layer of meltblown fibers, wherein the layer of meltblown fibers is between the two layers of spunbonded fibers, wherein the fibers forming at least one layer have been subjected to corona discharge; and wherein at least one layer of spunbonded fibers includes a surface treatment having a breakdown voltage no greater than 13 KV of direct current and wherein the layer of meltblown fibers includes a surface treatment having a breakdown voltage no greater than 13 KV of direct current.

11. The nonwoven electret of claim 10, wherein the meltblown fibers comprise a blend of polypropylene and polybutylene.

12. The nonwoven electret of claim 11, wherein the polybutylene is present in the blend in a range from 0.5 to 20 percent weight of the blend.

13. The nonwoven electret of claim 10, wherein the breakdown voltage of the surface treatment of the spunbonded fibers is less than 8 KV of direct current.

14. The nonwoven electret of claim 10, where the breakdown voltage of the surface treatment of the meltblown fibers is less than 8 KV of direct current.

15. The nonwoven electret of claim 10, wherein the meltblown fibers have been subjected to corona discharge.

16. A nonwoven web comprising:

at least two layers of spunbonded fibers and at least one layer of meltblown fibers, wherein the layer of meltblown fibers is between the two layers of spunbonded fibers, wherein fibers of at least one layer include a surface treatment having a breakdown voltage no greater than 13 KV of direct current, and wherein fibers of at least one layer include a surface treatment having a breakdown voltage greater than 13 KV of direct current; and wherein each layer of fibers having a surface treatment has been subjected to corona discharge.

17. The nonwoven web of claim 16, wherein the spunbonded fibers of one of the layers include a surface treatment having a breakdown voltage no greater than 13 KV direct current, and wherein the spunbonded fibers of another layer include a surface treatment having a breakdown voltage greater than 13 KV direct current.

18. The nonwoven web of claim 16, wherein the meltblown fibers include at least one of said surface treatments.

19. A nonwoven web comprising:

at least one layer of fibers which has been subjected to corona discharge, wherein the fibers include a first surface treatment having a breakdown voltage no greater than 13 KV of direct current, and wherein the fibers include a second surface treatment having a breakdown voltage greater than 13 KV of direct current.

20. The nonwoven web of claim 19, wherein the fibers comprise a blend of polypropylene and polybutylene.

21. The nonwoven web of claim 20, wherein the polybutylene is present in the blend in a range from 0.5 to 20 percent weight of the blend.

22. The nonwoven web of claim 19 wherein the breakdown voltage of the first surface treatment is less than 8 KV of direct current.

23. The nonwoven web of claim 19, wherein the breakdown voltage of the second surface treatment is less than 8 KV of direct current.

24. A nonwoven web comprising:

at least two layers of spunbonded fibers and at least one layer of meltblown fibers, wherein the layer of meltblown fibers is between the two layers of spunbonded fibers, at least one layer of fibers having been subjected to corona discharge, wherein at least one layer of fibers includes a first surface treatment having a breakdown voltage no greater than 13 KV of direct current, and wherein the at least one layer of fibers include a second surface treatment having a breakdown voltage greater than 13 KV of direct current.

25. The nonwoven web of claim 24 wherein at least one of the fibers which include a surface treatment having a breakdown voltage no greater than 13KV has been subjected to corona discharge.

26. The nonwoven web of claim 24 wherein the meltblown fibers comprise a blend of polypropylene and polybutylene.

27. The nonwoven web of claim 26 wherein the polybutylene is present in the blend in a range from 0.5 to 20 percent weight of the blend.

28. The nonwoven web of claim 24 wherein the breakdown voltage of the surface treatment of the spunbonded fibers is less than 8 KV of direct current.

* * * * *